US006981741B2

(12) United States Patent
Sirjoo

(10) Patent No.: US 6,981,741 B2
(45) Date of Patent: Jan. 3, 2006

(54) PORTABLE FOLDING CHAIR

(76) Inventor: Malbee B. Sirjoo, 715 Saginaw Pkwy., Cambridge, Ontario (CA), N1T 1V9

( * ) Notice: Subject to any disclaimer, the term of this patent is extended or adjusted under 35 U.S.C. 154(b) by 128 days.

(21) Appl. No.: 10/628,741

(22) Filed: Jul. 30, 2003

(65) Prior Publication Data

US 2005/0023875 A1 Feb. 3, 2005

(51) Int. Cl.
*A47C 1/16* (2006.01)

(52) U.S. Cl. ..... 297/254.13; 297/354.12; 297/377

(58) Field of Classification Search ..... 297/124, 297/354.12, 354.13, 368, 374, 377, 383
See application file for complete search history.

(56) References Cited

U.S. PATENT DOCUMENTS 609,177 A * 8/1898 Young ..... 297/112
740,567 A * 10/1903 Hunt ..... 297/354.13
2,208,945 A * 7/1940 Miller ..... 297/170
2,528,433 A * 10/1950 Hines ..... 297/378.12
2,571,139 A * 10/1951 Johnson ..... 297/377
3,822,917 A * 7/1974 George ..... 297/215.12
4,653,751 A * 3/1987 Green ..... 482/104
5,261,725 A * 11/1993 Rudolph ..... 297/354.13

* cited by examiner

*Primary Examiner*—Peter R. Brown
(74) *Attorney, Agent, or Firm*—Daryl W. Schnurr

(57) ABSTRACT

A portable folding chair without legs has a seat and a backrest. In a compact position, the seat and backrest lie substantially in the same plane with the backrest located immediately to the rear and sides of the seat. The chair has an upright position where the backrest is mounted at an angle that is greater than substantially 90° relative to the seat.

24 Claims, 6 Drawing Sheets

PORTABLE FOLDING CHAIR

BACKGROUND OF THE INVENTION

1. Field of the Invention

This invention relates to a chair having a seat and a backrest where the backrest is movable between upright position and a compact position. More particularly, the chair provides back support in situations where a user would otherwise be sitting on a horizontal surface without back support.

2. Description of the Prior Art

It is known to have chairs without legs having a seat and a backrest where the position of the backrest is adjustable relative to the seat. The backrest moves between an upright position and a folded position relative to the seat. The floor seat is bulky, the backrest doesn't have a cushion and the backrest is not very secure in an upright position.

A floor seat is described in U.S. Pat. No. 2,685,326 issued on Aug. 3, 1954. When moving from an unfolded position to a folded position, the backrest folds forward until a front surface of the backrest lies on an upper surface of the seat.

Previous chairs without legs are expensive to manufacture, are too heavy to be easily carried by a user, are too cumbersome even when folded, are unstable as they can tip too easily, are too uncomfortable for use over a long period of time or cannot be used as a chair when they are in a folded position.

SUMMARY OF THE INVENTION

It is an object of the present invention to provide a portable folding chair that can be used as a chair in a compact position and in an upright position. It is a further object of the present invention to provide a portable folding chair that can be moved from an upright position to a compact position in which a backrest lies in the same plane as a seat.

A chair has a seat and a backrest, the seat having an upper surface and a lower surface, the backrest having a front surface and a rear surface. The chair is readily movable between an upright position and a compact position. In an upright position, the backrest is mounted in a fixed position relative to the seat so that an angle between the upper surface of the seat and the front surface of the backrest is greater than substantially 90°. In the compact position, the angle is much greater than 90° and the seat and the backrest lie substantially in the same plane.

Preferably, in a compact position, the angle between the upper surface of the seat and the front surface of the backrest is substantially 180°.

A chair has a seat and a backrest. The backrest has an inverted U shape with two legs extending downward from a central portion. Each of the legs has a free end that is slidably connected to either side of the seat, the legs straddling the seat. The backrest lies outside of the seat immediately to the rear and sides thereof when the chair is in a compact position. The backrest is at an angle that is greater than substantially 90° when the chair is in an upright position.

Preferably, a pneumatic cylinder extends directly or indirectly between a seat and the free end of each of the legs.

A method of moving a chair between a compact position and an upright position uses a chair having a seat and a backrest. The seat has an upper surface and a lower surface, the backrest having a front surface and a rear surface. The seat and backrest are in contact with one another. The method comprises, commencing with the chair in a compact position and the seat and the backrest lying substantially in the same plane, pulling the backrest upward and rearward relative to the seat, manipulating the backrest to lock the backrest in an upright position relative to the seat, subsequently manipulating the backrest to unlock the backrest from the upright position, moving the backrest downward and forward to return the chair to the compact position.

DETAILED DESCRIPTION OF A PREFERRED EMBODIMENT

Figure 1:
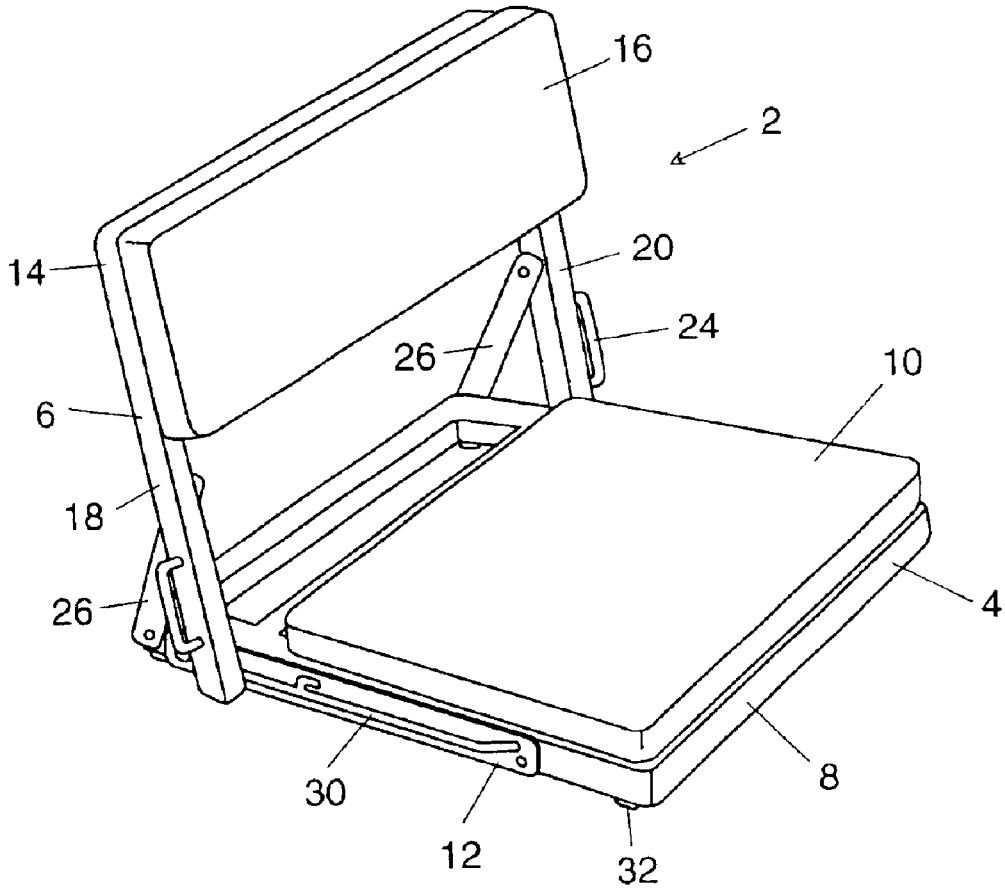
FIG. 1 is a perspective view of a chair in an upright position.
Figure 2:
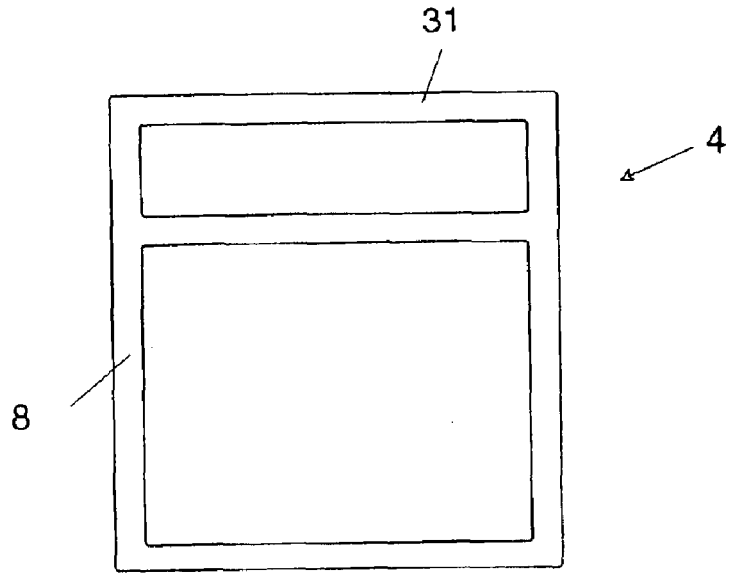
FIG. 2 is a top view of a frame for the seat.

In FIG. 1, a chair 2 has a seat 4 and backrest 6. The seat 4 has frame 8 with a cushion 10 thereon. Along each side of the seat 4, there is mounted a bracket 12. The backrest 6 has a frame 14 with a cushion 16 mounted on an upper portion thereof. The backrest 6 is mounted in contact with the seat 4. As can best be seen from FIG. 3, the frame 14 has two legs 18, 20 extending downward from a central portion 21 with a connector 22 extending inward from a free end 23 each of the legs 18, 20. The frame 14 has the shape of an inverted U. A handle 24 is mounted on an outer surface of each of the legs 18, 20. There are two braces 26 that are pivotally mounted at each end of the brace between each leg 18, 20 of the frame 14 of the backrest 6 and each side of the frame 8 of the seat 4 to a rear of said backrest. The connectors 22 are tiny posts with an enlarged inner end 28. The posts 22 slide within a slot 30 of each of the brackets 12 on either side of the seat 4 respectively. The braces 26 provide support for the backrest 6 when it is in an upright position as shown in FIG. 1. At each corner of the seat 4, there is located a small pedestal 32 (only one of which is shown in FIG. 1). The pedestals 32 raise the seat 4 slightly above any supporting surface (not shown) on which the chair 2 is viewed. In FIG. 2, there is shown a top view of the frame 8 of the seat 4.

Figure 4:
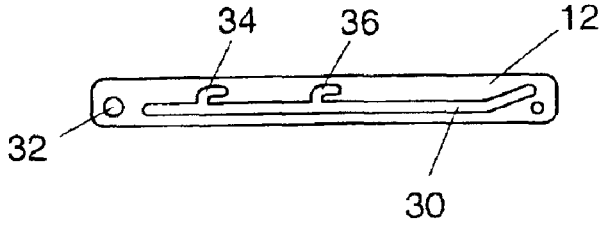
FIG. 4 is a side view of a bracket.

In FIG. 4, there is shown a side view of one of the brackets 12. The brackets 12 on either side of the chair 2 are mirror images of one another. There are two openings 32 in each of the brackets 12 and the brackets are affixed to the frame 8 of the seat 4 by screws (not shown). The slot 30 is an elongated slot that slopes upward toward a front of the chair 4. The slot 30 has two inverted L-shaped notches 34, 36 extending upward therefrom. In the upright position shown in FIG. 1, the backrest 6 is pivotally mounted within the notches 34 via the connectors 22.

Figure 5:
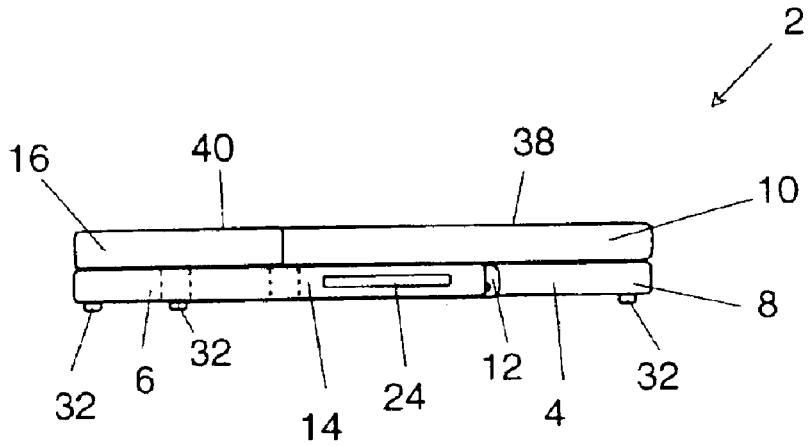
FIG. 5 is a side view of the chair in a compact position.

In FIG. 5, the chair 2 is shown in a compact position. The same reference numerals are used in FIG. 5 to describe those components that are identical to the components shown in FIG. 1. It can be seen that there is a pedestal 32 located at each of the upper corners of the backrest 6. In the compact position, the seat 4 and backrest 6 lie in the same plane.

Figure 6:
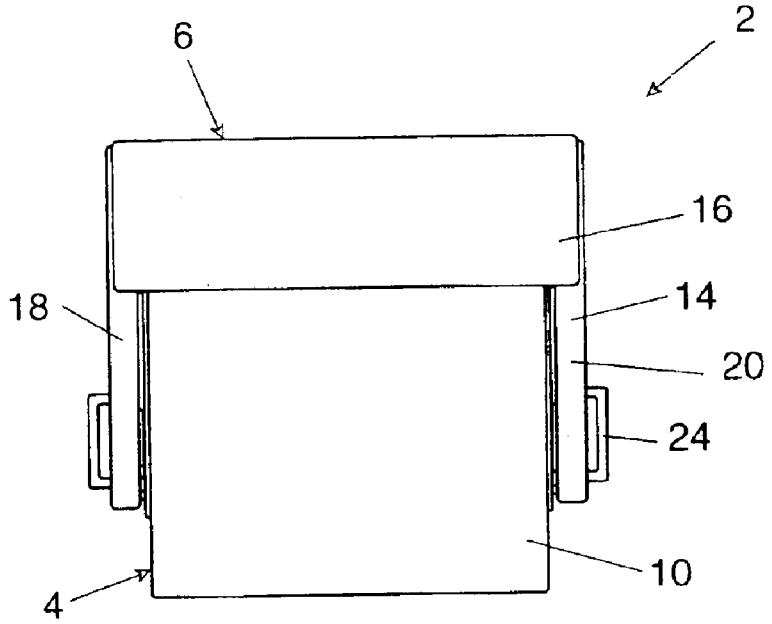
FIG. 6 is a side view of the chair in an upright position.

In FIG. 6, there is shown a top view of the chair 2 in the compact position. The same reference numerals are used in FIG. 6 as those used in FIGS. 1 and 5 for those components that are identical.

Figure 7:
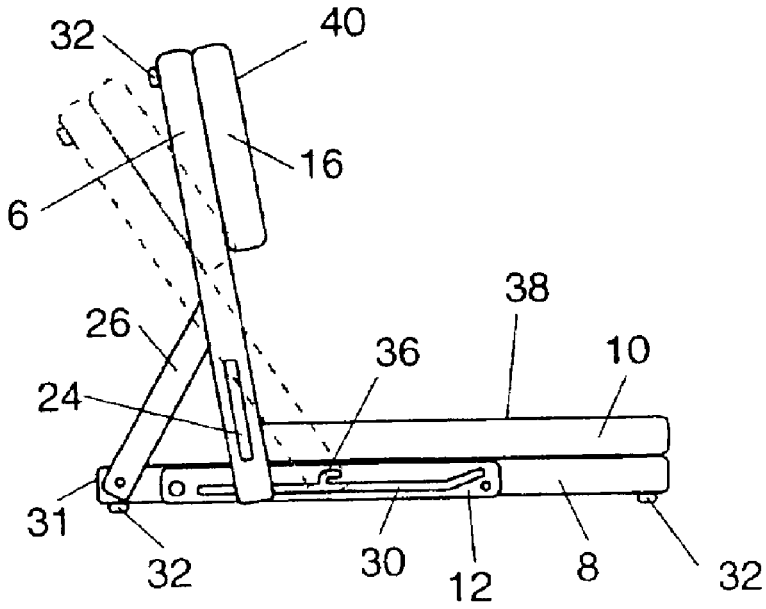
In FIG. 7, there is shown a top view of the chair in a compact position.

In FIG. 7, there is shown a side view of the chair 2 in the first upright position, being the same upright position as that shown in FIG. 1. The same reference numerals are used in FIG. 7 as those used in FIGS. 1 and 5 to describe those components that are identical. The chair 2 has a second upright position which is shown in FIG. 7 by dotted lines. In the first upright position, the connectors 22 are pivoted in the notches 34 and in the second upright position, the connectors 22 are pivoted in the notches 36. The notch 34 is not shown in FIG. 7 as it is hidden by the side 18 of the backrest 6. Only one of the notches 36 is shown in FIG. 7.

Figure 8:
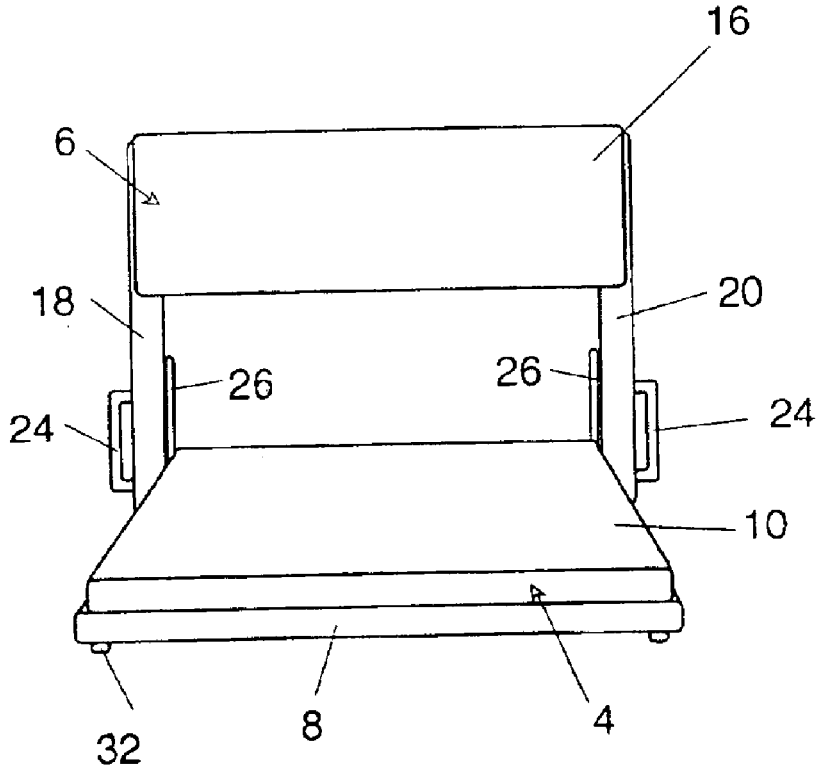
FIG. 8 is a front view of the chair in an upright position.

In FIG. 8, there is shown a front view of the chair 2 in the first upright position shown in FIGS. 1 and 7. The same reference numerals are used in FIG. 8 as those used in FIGS. 1 and 7 to describe those components that are identical.

Figure 3:
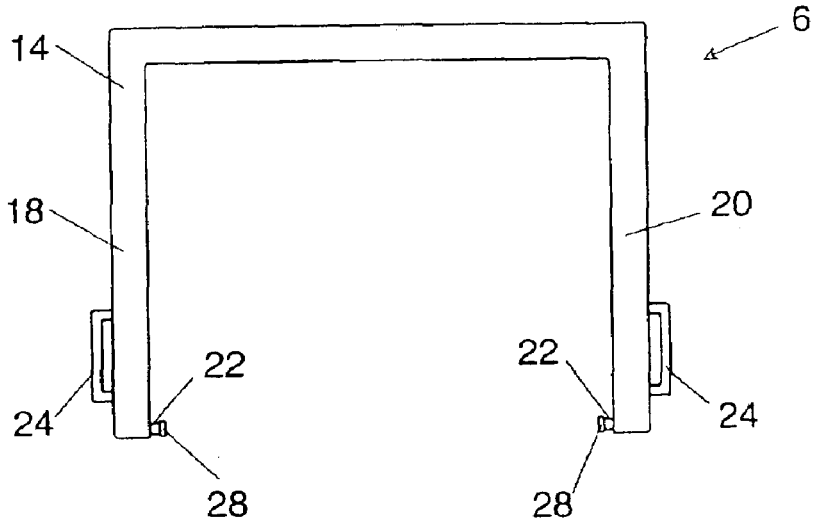
FIG. 3 is a top view of a frame for the backrest.

By comparing FIGS. 2 and 3 with FIGS. 5 and 6, it can be seen that when the chair is in a compact position, the frame 14 is aligned with and immediately adjacent to an exterior of a rear member 31 and sides of the frame 8 of the seat 4. The cushion 16 fills the gap that would otherwise exist between a rear 31 of the frame 8 and the cushion 10 of the seat 4 when the chair 2 is in the compact position.

The compact position is the carrying or transporting position of the chair 2. However, even in the compact position, the chair 2 has an advantage over previous chairs in that the cushions 10, 16 of the seat 4 and backrest 16 are oriented side by side in substantially the same plane. An angle between an upper surface 38 of the cushion 10 of the seat 4 and an upper surface 40 of the cushion 16 of the backrest 6 are at an angle of substantially 180° relative to one another. In the first upright position shown in FIG. 7, the angle of the upper surface 38 to the front surface 40 is greater than 90° and is substantially 100°. In the second upright position shown in FIG. 7 by way of dotted lines, the angle is substantially 125°. If desired, the chair could have upright positions at different angles than those shown simply by relocating the notches on the brackets 12. Further, more than two upright positions could be utilized by locating more than two notches in the brackets 12.

In operation, to move the chair from the compact position shown in FIG. 5 to each of the two upright positions shown in FIG. 7, the backrest is pulled rearward and upward relative to the seat. The connectors 22 slide along the slot 30 until the connectors can be guided into the notch 34. When the connectors are located properly within the notch 34, the backrest is locked in the first upright position. To move out of the first upright position, the handles 24 are pulled backward slightly and the connectors are manipulated out of the notch 34. From that position, the backrest can be pivoted toward the rear and the connectors can slide toward the compact end of the bracket 12 to return the chair to the compact position. Alternatively, after the connectors have been removed from the slot 34, the handles can be pulled to move to connectors into the slot 36. When the connectors are properly located within the slot 36, the backrest will be locked in the second upright position. As can readily be seen from FIG. 7, the backrest leans further back in the second upright position than it does in the first upright position. To move the backrest out of the second upright position, the handles 24 are forced slightly rearward until the connectors are back in the main part of the two slots 30. The chair can then be moved either to the first upright position or back to the compact position.

Figure 9:
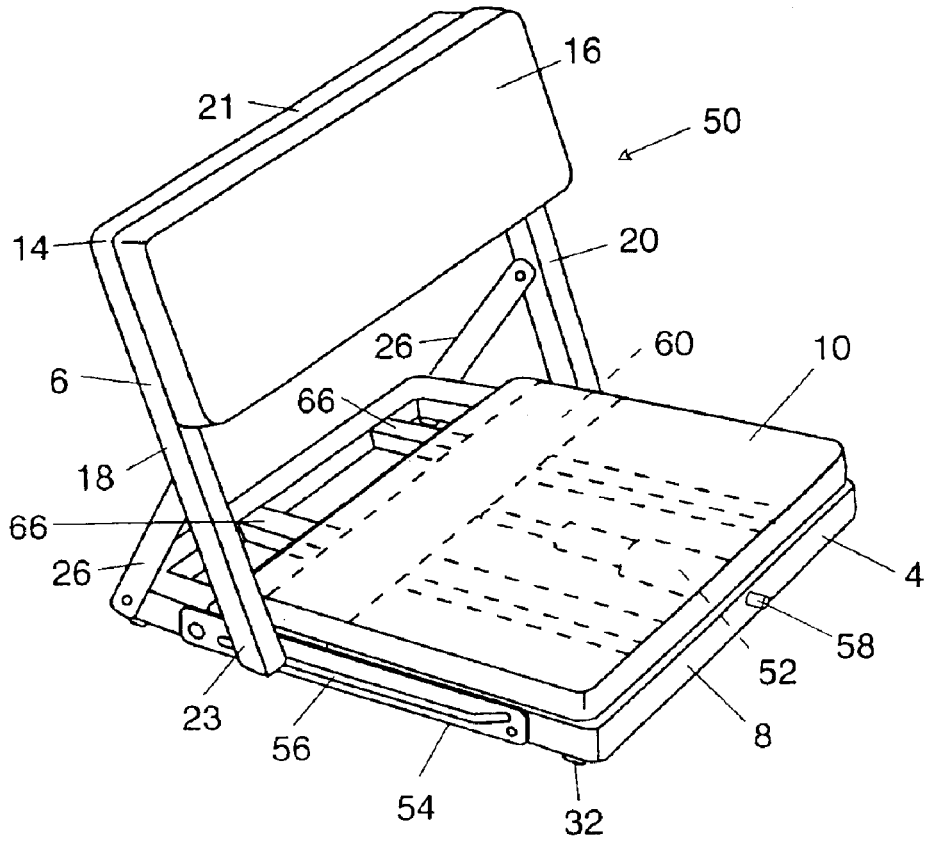
FIG. 9 is a perspective view of a further embodiment of a chair in an upright position.
Figure 10:
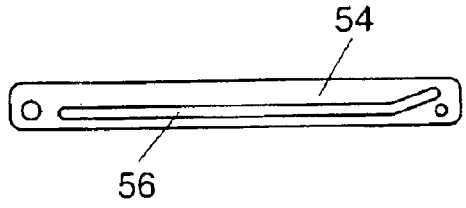
FIG. 10 is a side view of a bracket for the chair FIG. 9.
Figure 11:
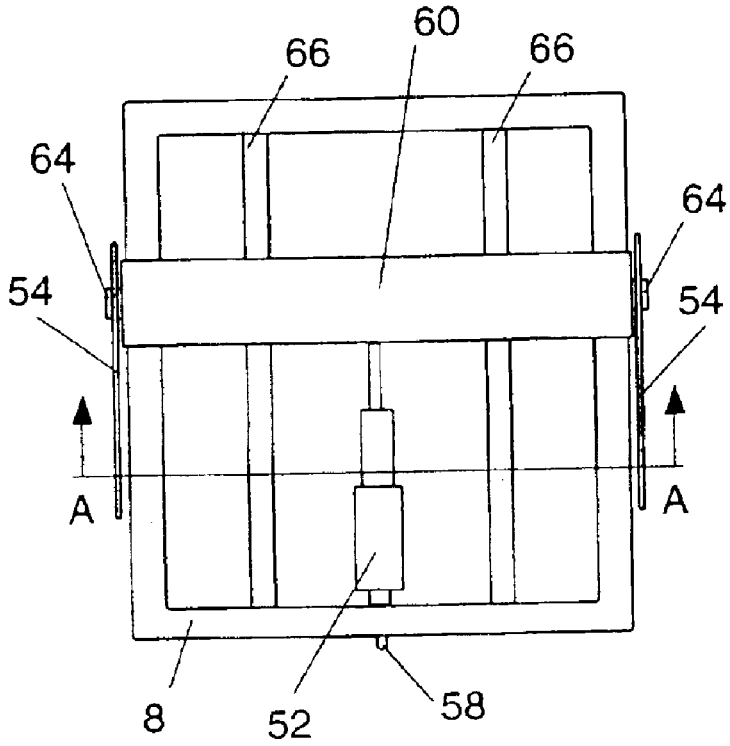
FIG. 11 is a top view of the chair shown in FIG. 9 with the cushions removed.
Figure 12:
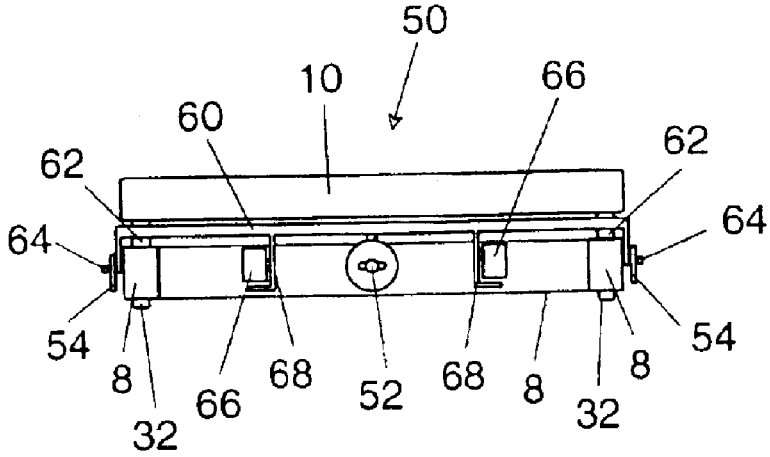
FIG. 12 is a schematic sectional view through the line A—A of FIG. 11 with the cushion replaced.

In FIGS. 9 to 12, there is shown a further embodiment of a chair 50 that is operable by a pneumatic cylinder 52 located between the seat 4 and backrest 6. The same reference numerals are used in FIGS. 9 to 12 as those used in FIGS. 1 to 8 for those components that are identical. FIG. 9 is a perspective view of the chair 50 with the pneumatic cylinder 52 shown by dotted lines. FIG. 10 is a side view of a bracket 54 having a slot 56 that slopes upward toward the front 4 of the chair 50. In FIG. 11, it can be seen that the cylinder 52 has an activator 58 protruding from a front of the frame 8 of the seat 4. The cylinder 52 spins between the front of the frame 8 of the seat 4 and a cross member 60. The cross member 60 is slidable above the frame 8 and beneath the cushion 10. A space is created between the frame 4 and the cushion 10 by four posts 62, which are best seen in FIG. 12. Only two of the four posts 62 are shown in FIG. 12. The posts 62 are located outside the moveable range of the cross member 60. The cross member 60 has two projections 64, one projection 64 being located at each end of the cross member. The projections 64 extend through the slot 56 on each of the brackets 54 on either side of the chair 52. The free end of the legs 18, 20 are affixed to the projections 64 so that the backrest straddles the frame 8 in the compact position (not shown in FIGS. 9 to 12). The frame 8 has longitudinal guides 66 extending from front to rear which interact with L-shaped hooks 68 extending downward from the cross member 60. The hooks 68 and longitudinal guides 66 keep the cross member aligned with the frame 8. The pneumatic cylinder 52 has an extended position as shown in FIGS. 9 and 11 and a retracted position (not shown). In the extended position shown, the chair is in an upright position. In the retracted position, the cross member will be moved toward the front of the seat 4, thereby pulling the legs 18, 20 toward the front of the slot 56 and moving the backrest into the compact position. The compact position is not shown for the chair 52, but is essentially the same as the compact position shown for the chair 2 in FIGS. 5 and 6. The only real difference is that the cushion 10 must be raised slightly above the frame 8 as previously stated to allow space for the cross member to move. Since the cylinder 52 has various extended positions, the angle of the backrest relative to the seat can be adjusted to the comfort of the user and readjusted, if desired. Preferably, the cylinder is designed to move to the extended position when the activator 58 is pushed to one side if there is no external force placed on the backrest. Further, the cylinder 52 is designed to retract when the activator 58 is pushed to one side an external force downward on the backrest. When moving the chair to a compacted position from an upright position, the activator 52 is moved to one side and the backrest is simultaneously manually pushed downward until the compact position has been attained. The cushions 10 have been removed in FIG. 11 to expose the frame 8.

The chair of the present invention has several advantages. The backrest moves from the upright position to the compact position by pivoting the backrest further rearward away from the upper surface 38 of the cushion 10. If the backrest were moved to the compact position by pivoting the backrest forward, the chair would be at least twice as thick in the folded position than it is in the compact position shown in FIG. 5. Also, even though the cushion 16 lies side by side with the cushion 10 in the compact position, the length of the chair from front to rear in the compact position is only about 25% greater than the length of the chair from front to rear when the chair is in an upright position.

When the chair is in the first upright position, the pivot point of the backrest relative to the seat is at the notch 34. The distance from the notch 34 to the rear 31 of the frame 8 adds stability to the chair and greatly increases the difficulty of tipping the chair over backward. In the second upright position, the backrest is pivoted at the notch 36 relative to the seat 4. In this position, even thought the centre of gravity of a user of the chair is moved more toward the rear because the backrest is tilted back further, the greater distance of the notch 36 to the rear member 31 results in the chair being extremely stable.

While the chair of the present invention is designed to make "sitting on the floor" much more comfortable to a user, the chair could also be used on flat surfaces to provide back support. If one sits on the floor, without back support, the sitting position soon becomes extremely uncomfortable. With the chair of the present invention, one can sit on the chair, while the chair rests on the floor, relatively comfortably for a much longer period of time. The chair of the present invention is portable and can easily be moved from one location to another and can easily be carried by a user for long distances.

I claim:

1. A chair comprising a seat and a backrest, said seat having an upper surface and a lower surface, said backrest having a front surface and a rear surface, said seat having two sides with an elongated slot located on each side, said backrest having an inverted U-shape with two legs extending downward from either end of an upper portion, each of said legs having a free end with a connector extending inward from said free end, said backrest being sized and shaped to fit outside of said sides of said seat with said connectors slidably connected to said slots, there being two slots and two connectors with one connector in each slot, said chair being readily movable between an upright position and a compact position:

(a) in a compact position, said seat and said backrest lying substantially in the same plane with an angle between said upper surface of said seat and said front surface of said backrest being substantially 180°;

(b) in an upright position, said backrest being mounted in a fixed position relative to said seat so that said angle greater than substantially 90°, said free ends moving along each side of said seat as said backrest moves between positions with said connectors sliding within said slots.

2. A chair as claimed in claim 1 wherein each slot has a notch to receive one of said connectors when said chair is in said upright.

3. A chair as claimed in claim 2 wherein said backrest has two upright positions relative to said seat, a first upright position and a second upright position, in a first upright position, said angle being approximately 95° and in a second upright position, said angle being approximately 105°, said slot having a notch for each upright position.

4. A chair as claimed in claim 2 wherein said seat has a first frame, said first frame having a front portion and a rear portion, said slot being located on either side of said first frame, said backrest having a second frame, said legs being part of second frame said second frame being sized and shaped to fit outside of said first frame with said connectors slidably connected to said slots.

5. A chair as claimed in claim 4, wherein there is a first cushion on a front portion of said first frame and a second cushion on an upper portion of said second frame, said cushions being sized and shaped so that said cushions are adjacent to one another when said chair is in a compact position.

6. A chair as claimed in claim 5 wherein said first frame has a rectangular shape.

7. A chair as claimed in claim 6 wherein there are no legs on said first frame.

8. A chair as claimed in claim 6 wherein there are four pedestals mounted on a lower surface of said first frame near corners of said first frame.

9. A chair as claimed in claim 8 wherein there are two handles on said second frame, there being one handle on each side of said second frame, said handles extending outward from a lower portion of said second frame.

10. A chair as claimed in claim 1 wherein said seat has two brackets thereon, one of said two brackets being located along each side of said seat, said slot having a notch for each upright position.

11. A chair as claimed in claim 10 wherein each bracket has an elongated slot therein, said slot having a compact end at which said connector is located when said chair is in said compact position and at least one upright position, said connector being a post connector with an enlarged inner end, said inner end sliding within said bracket.

12. A chair as claimed in claim 11 wherein each slot is generally horizontal with said compact end angling gently upward, with a first upright position for said connector being a short distance to a notch that extends upward and forward.

13. A chair as claimed in claim 12 wherein said chair has a second upright position, said second upright position for said connector in each slot being a second notch located between said first upright position and said compact end, said second notch extending upward and forward.

14. A chair as claimed in claim 13 wherein, in an upright position, a rear edge of said seat extends beyond a rear surface of said backrest and there is a support brace on either side of said chair, each support brace being pivotally connected at one end to said backrest and at another end to a side of said seat to a rear of said backrest.

15. A chair as claimed in claim 14 wherein said brace is pivotally mounted to the side of said seat at a rear end of said seat.

16. A chair comprising a seat and a backrest, said seat having an upper surface and a lower surface, said backrest having a front surface and a rear surface, there being a slot located on each side of said seat, said backrest having two arms that straddle said seat, each arm having a free end with a connector extending inward therefrom, each connector being slidably located in one of said slots, said chair being movable between an upright position and a compact position:

(a) in an upright position, said backrest being mounted in a fixed position relative to said seat with an angle between said upper surface of said seat and front surface of said backrest being greater than substantially 90°; and (b) in a compact position, said angle being much greater than 90° and said seat and said backrest lie substantially in the same plane, said backrest being movable between positions by sliding relative to said seat.

17. A chair as claimed in claim 16 wherein the seat has a front portion and a rear portion, with brackets being mounted on either side of the seat, one of said slots being located in each of said brackets, said backrest having an inverted U-shape with two legs extending downward from either end of a central portion, each of said legs having a free end with a connector extending inward from said free end, said backrest being sized and shaped to fit outside of said seat with said connectors slidably connected to said brackets.

18. A chair as claimed in claim 16 wherein said two legs straddle said seat in said compact position.

19. A chair as claimed to claim 18 where said chair has a pneumatic cylinder, said cylinder being connected between said seat and said free ends of said backrest, there being a brace on either side of said chair, each brace being pivotally connected between said seat and said backrest and extending to a rear of said backrest, said cylinder being connected to said free cads of said legs, with an activator for said cylinder to move said chair between said compact position and said upright position.

20. A chair as claimed in claim 19 wherein said chair has several upright positions.

21. A chair as claimed in claim 20 wherein said cylinder has a retracted position and several extended positions corresponding to said compact position and said several upright positions of said chair respectively.

22. A chair comprising a seat and a backrest, said backrest having an inverted U-shape with two legs extending downward from a central portion, each of said legs having a free end that is slidably connected to either side of said seat, said legs straddling said seat, said backrest lying outside of said seat immediately to a rear and sides thereof when said chairs in a compact position, said backrest being at an angle that is greater than substantially 90° to said seat when said chair is in an upright position, said backrest being slidably connected to said seat and said backrest being slidable relative to said seat to move between positions.

23. A method of moving a chair between a compact position and an upright position, said chair having a seat and a backrest, said seat having an upper surface and a lower surface, said backrest having a front surface and a rear surface, said seat and backrest being in contact with one another, said method comprising, commencing with the chair in a compact position and said seat and said backrest lying substantially in the same plane pulling said backrest upward and sliding said backrest rearward relative to said seat, manipulating said backrest to lock said backrest in an upright position relative to said seat, subsequently, manipulating said backrest to unlock said backrest from said upright position, moving said backrest downward and sliding said backrest forward relative to said seat to return said chair to said compact position.

24. A method as claimed in claim 23 wherein said backrest has an inverted U shape with two legs extending downward from a central portion, each leg having a free end, a pneumatic cylinder being connected directly or indirectly between said seat and said free end, there being a brace on either side of said chair, each brace being pivotally connected between said seat and said backrest and extending to a rear of said backrest, said cylinder having an activator thereon, said method comprising manipulating said activator to move said chair from a compact position to an upright position and manipulating said activator while forcing said backrest downward and forward to move said chair from said upright position to said compact position.

* * * * *